US006883880B2

(12) United States Patent
Flores

(10) Patent No.: US 6,883,880 B2
(45) Date of Patent: Apr. 26, 2005

(54) FLOATING SUB-TOP AND SUPPORT MEMBER

(76) Inventor: Leo Flores, P.O. Box 467, Bonsall, CA (US) 92003

( * ) Notice: Subject to any disclaimer, the term of this patent is extended or adjusted under 35 U.S.C. 154(b) by 6 days.

(21) Appl. No.: 10/325,282

(22) Filed: Dec. 19, 2002

(65) Prior Publication Data

US 2004/0119381 A1 Jun. 24, 2004

(51) Int. Cl.[7] ..... A47B 43/00

(52) U.S. Cl. ..... 312/140.4; 52/702; 108/157.18; 248/300

(58) Field of Search ..... 52/699, 702; 312/140.1–140.4; 108/157.1, 157.18; 248/220.1, 300

(56) References Cited

U.S. PATENT DOCUMENTS

| | | | | | |
|---|---|---|---|---|---|
| 426,552 | A | * | 4/1890 | Smead | 52/702 |
| 804,451 | A | * | 11/1905 | Carlson | 52/702 |
| 862,498 | A | * | 8/1907 | Mohan | 52/702 |
| 960,934 | A | | 6/1910 | Hunter | |
| 1,385,478 | A | | 7/1921 | Shermilt | |
| 2,191,500 | A | * | 2/1940 | Rosling | 52/202 |
| 2,205,700 | A | | 6/1940 | Smith | 189/85 |
| 2,711,789 | A | * | 6/1955 | Boyle et al. | 160/106 |
| 2,823,427 | A | | 2/1958 | Kuhlman | 20/6 |
| 3,395,507 | A | | 8/1968 | Moody | 52/390 |
| 4,215,517 | A | * | 8/1980 | Everson | 52/202 |
| 4,325,597 | A | * | 4/1982 | Morrison | 312/258 |
| 4,449,342 | A | | 5/1984 | Abendroth | 52/393 |
| 4,523,412 | A | * | 6/1985 | Sielaff | 52/81.3 |
| 4,560,301 | A | * | 12/1985 | Gilb | 52/702 |
| 4,920,725 | A | * | 5/1990 | Gore | 52/702 |
| 5,447,004 | A | | 9/1995 | Vrnak | 52/387 |
| 6,237,295 | B1 | | 5/2001 | Ballard | 52/589.1 |

* cited by examiner

*Primary Examiner*—Peter R. Brown
(74) *Attorney, Agent, or Firm*—Frank G. Morkunas

(57) ABSTRACT

A system for creating a floating sub-top into an open space of a counter upon which tiles may be applied. The float characteristic of the sub-top eliminates cracking and breaking of tiled corner pieces and grout due to expansion of the sub-top. Used with the system is a support member attachable to vertical upstanding walls of the counter on the ends of the walls or on the inner surfaces; and attachable to the sub-top.

12 Claims, 2 Drawing Sheets

FLOATING SUB-TOP AND SUPPORT MEMBER

CROSS REFERENCES TO RELATED APPLICATIONS

None

STATEMENT REGARDING FEDERALLY-SPONSORED RESEARCH OR DEVELOPMENT

None

BACKGROUND OF THE INVENTION

This present invention relates to an improvement in counter construction, and more particularly to the top sections of counters which form the sub-base for tiles to be applied thereon.

Conventionally counters are made with the top section either directly and completely covering the vertical perimeter walls forming the counter. In the industry, the top section is generally referred to as the sub-top in that it is the foundation upon which the finished top; i.e., tiles for example, are applied. Most sub-tops are composed of wood though other materials may be used.

Typically the sub-tops are fastened [nailed, screwed, glued] onto the vertically-disposed walls of the counter. The attachment of the sub-top to the upstanding vertical walls in this manner is also generally of a permanent nature. Once the sub-top is so attached, cement is applied to it and tiles thereafter are applied to the cement. Tiles placed on the sub-top are so placed such that the edges of one tile do not abut the edges of another tile. They should be, and are, spaced apart from one another. This is done because tiles expand and contract. If the tiles are permanently set in place with the edges of all tile abutting the edges of other tiles, the tiles would crack upon expansion. Grout is applied into the spaces to finish the top. Most finished tiled counters also have corner caps/tiles cemented into place at the corners formed by the top and its adjacent vertical wall to give an even more finished appearance.

Wood, as well as the other materials generally used for sub-tops, also expands and contracts. Since the sub-top is permanently affixed to the vertical walls of the counter, such movement [expansion and contraction] of the fixed sub-top would, and does, push outward against the corner caps thereby causing them or the grout between the caps or both to separate or crack. The once finished; crisp, and clean look of the newly tiled counter becomes unsightly and damaged necessitating repairs, replacement, or, in many cases, neglect. The same result occurs with counters abutting walls. The non-floating sub-top expands pushing the tiles cemented thereon into the immovable wall causing the tiles or grout or both to crack or separate.

Attempts to correct this result or to prevent it altogether have been made with little success. Such attempts include modifying the joints, inserting expansion joints of various sorts, and use of various brackets and fasteners for and between the tiles. None has been successful in preventing this problem from occurring.

The floating sub-top system of the present invention with unique support members, when properly applied, will virtually eliminate the cracking to corner caps caused by the excessive expansion and contraction of a fixed sub-top as mentioned.

Accordingly, several objects and advantages of my invention are to:

a. establish an easy-to-use and easy-to-apply sub-top;

b. eliminate damage to tiles, and in particular, to corner caps, caused by expansion of a sub-top to which the tiles and corner caps are applied; and c. provide unique mounting members to create a floating sub-top within upstanding perimeter walls.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates a system for creating a floating sub-top for use on a counter upon which tiles are to be applied. The float is created by a inserting a sub-top having a lesser length and width than the length and width of the open space into which the sub-top is inserted creating a gap around the perimeter of the sub-top and the inner surface of the upstanding vertical walls forming the counter. Unique support member attach to the inner surface of the vertical walls or on the upper ends of the vertical walls, or onto the sub-top or any combination thereof. In one embodiment, the support member has a support ledge upon which the sub-top is placed after the support member has been attached to the vertical walls. In another embodiment, the support member has a retaining ledge above and parallel to the support ledge defining a mouth into which the sub-top may be inserted and fastened after which the sub-top, with this support member attached, in inserted into the open space of the counter. After installation of the sub-top and tiles thereon, as the sub-top expands and contracts, the gap permit the sub-top to expand into the gap and not to push the vertical wall with the horizontal expansion; i.e., 'float' therein. This prevents or greatly reduces cracking and breaking of the finished tiles and grout on the sub-top and corners.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which.

DETAILED DESCRIPTION OF THE INVENTION

Figure 1:
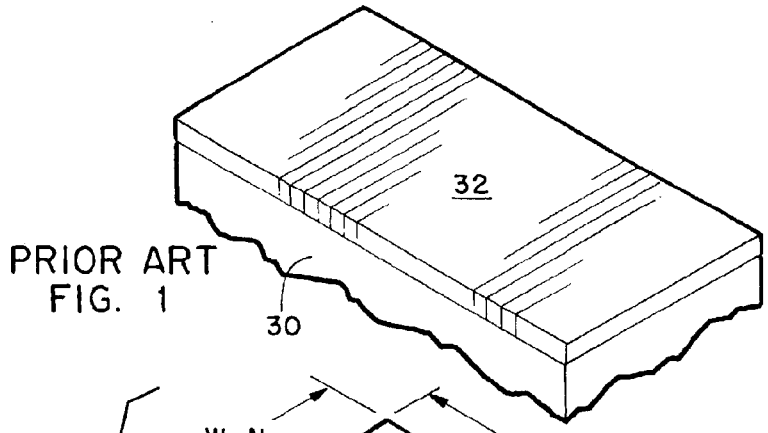
PRIOR ART FIG. 1
FIG. 1 is a perspective view of a typical conventional prior art sub-top for a counter

Referring now to the drawings in detail and in particular to FIG. 1, reference characters 30, 32 generally designate a prior art configuration of counter 30 [or similar structure having upstanding walls] with a top 32 attached, not within the open space of the counter 30, but securely on top of the upstanding walls of the counter 30. The top 32 is placed onto the upper ends of the upstanding walls of the counter 30 and typically is permanently affixed thereto. As previously described, cement is applied to the top 32 followed by tile application. Corner pieces are placed on the edge surfaces where the horizontal and vertical planes of the top 32 and counter 30, respectively, meet. As the surface area of the top 32 expands, the corner tiles applied to prior art structures as illustrated in this figure crack, break, and/or separate.

Figure 2:
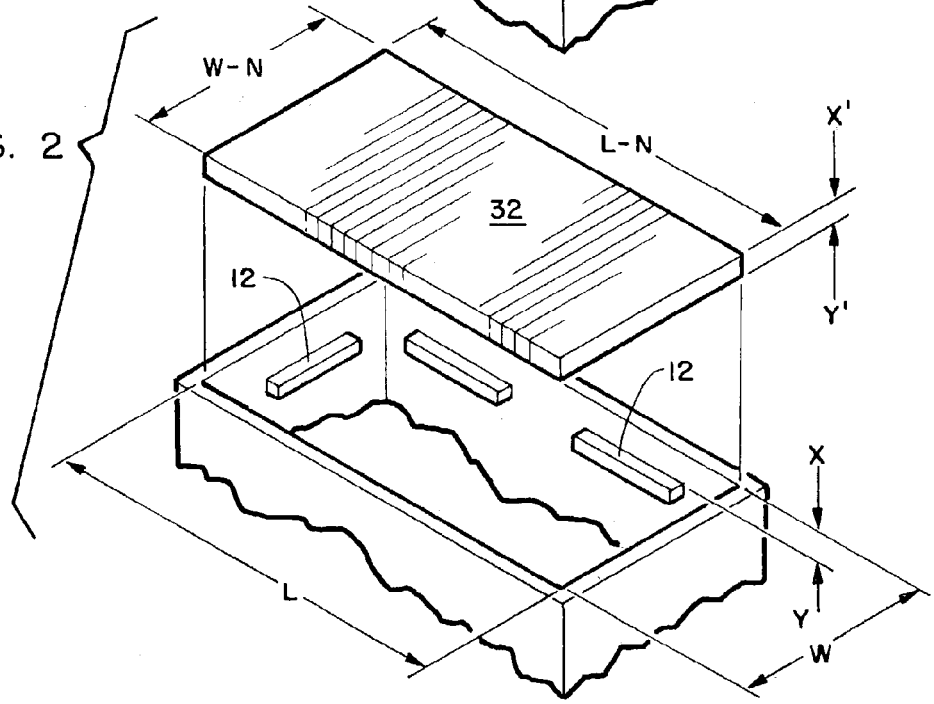
FIG. 2 is a detailed exploded perspective view of the sub-top of the present invention.
Figure 3:
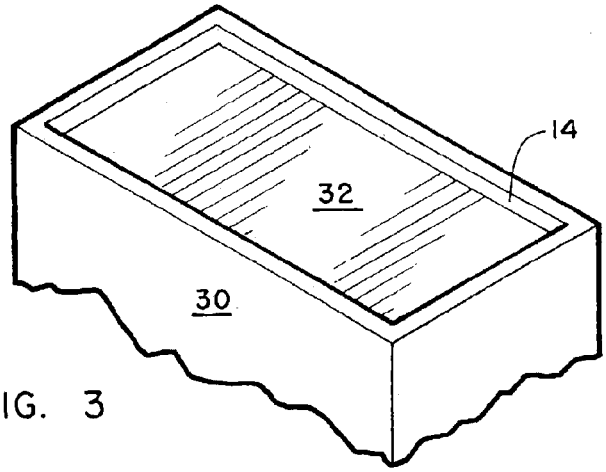
FIG. 3 is a detailed perspective view of the sub-top of the present invention.

FIGS. 2 and 3 illustrate a floating sub-top constructed in accordance with one embodiment of the present invention. The counter 30 has several upstanding vertically disposed walls exposing, in FIG. 2, an open space. The counter 30, if placed into a corner, may have as few as one vertically disposed wall if placed on a diagonal to the walls forming the corner. The walls forming the corner, though independent of the single separate vertically disposed wall of the counter, nonetheless also contribute to the formation of the counter 30 and, as a result are an integral part of the counter 30 in this configuration and hereby are considered to be two upstanding vertically disposed walls of the counter 30. Hence, in such a configuration, this type of diagonal counter into a corner has at a minimum three vertically disposed upstanding walls.

Counters not abutting walls may consist of a minimum of two vertically disposed upstanding walls with cross-members connected to each of the two vertically disposed upstanding walls to provide support for the counter. Regardless of the counter's 30 configuration, at least two vertically disposed upstanding walls, or more, are necessary to create the counter 30. The figures presented herein illustrate counters 30 which are independent of any external sources for their make-up. It must be understood that this is only for illustration purposes and not by limitation as to the inventive steps and structure of the present invention.

On the inside inner surface of the counter 30, there are shown several support members 12. These support members 12 are horizontally disposed and placed below the upper end of the vertically disposed upstanding walls. The distance from the top surface of the support members 12 to the upper end of the vertically disposed upstanding walls is represented by reference characters X-Y. At least two such support members 12 are required. If only two are used, they must be placed on opposing inner sides of the vertically disposed upstanding walls; ;i.e., on inner front wall and on inner back wall; or on right side inner wall and on left side inner wall. The purpose of the support members 12 is to hold and support the sub-top 32 when it is placed into the open space of the counter 30. It is, however, better to use at least three or more such support members 12.

The sub-top 32 in all cases must have a surface area less than the surface area of the open space and the linear dimensions of the sub-top 32 should be approximately proportional to the linear dimensions of the open space but must be slightly less. For example, if the length of the open space is L and its width is W, the length of the sub-top 32 must be L-n and its width must be W-n; where 'n' represents any distance less than L and W, respectively but not so much less that the sub-top 32, when placed into the open space is not capable of resting on the support members 12 therein. The thickness or depth of the sub-top 32 is represented by X'-Y' where X'-Y' is approximately equal to X-Y. Therefore, once the sub-top 32 is placed into the open space and is supported and resting on the support members 12, the top surface of the sub-top 32 is approximately even with the upper ends of all the vertically disposed upstanding walls of the counter 30 and creates a complete counter 30 or similar structure upon which cement followed by tiles may be applied. As configured and constructed, the sub-top 32 is a 'floating' sub-top 32 in that, because its surface area is less than the surface area of the open space, a gap or spacing 14 is left all around the perimeter of the sub-top 32 giving the finished sub-top 32, complete with its cemented tiles thereon, room into which to expand and not force the sub-top 32 and its cemented tiles to push into the corner pieces and crack, break, or separate them.

Figure 4:
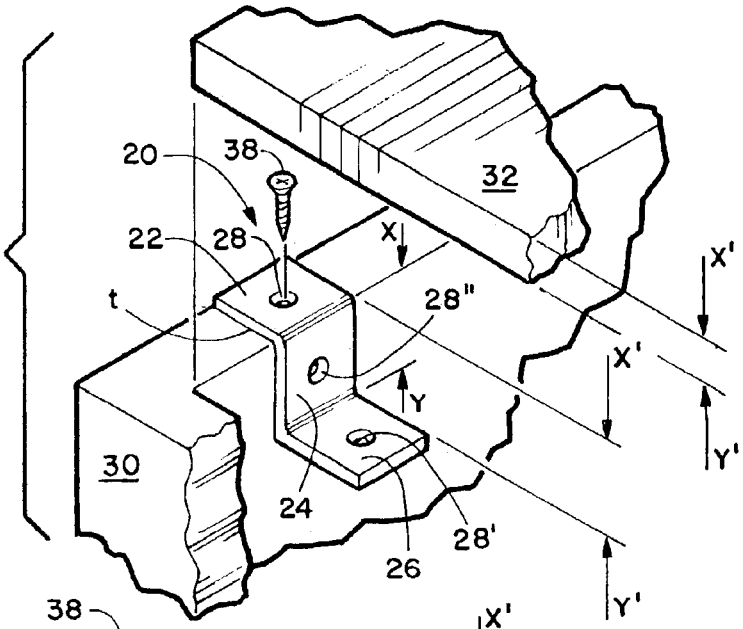
FIG. 4 is a detailed view of one embodiment of a support member for the sub-top.

FIG. 4 illustrates another embodiment of the support member 20. This support member 20 will be described based on relative orientation to the counter 30 to which it shall be mounted. It has a horizontal top ledge 22, an appended vertical, downward extending ledge 24, and an appended support ledge 26 extending outward from the vertical ledge 24 but extending inward into the open space of the counter 30 when mounted on the vertically disposed upstanding walls. It may have an aperture 28 on the top ledge 22 or an aperture 28' on the support ledge 26 or an aperture 28" on the vertical ledge 24 or on all or any combination thereof. This support member 20 may first be mounted onto and attached to any one or more of the vertically disposed upstanding walls by inserting a suitable fastener 38 through aperture 28 or aperture 28" or both in instances where the support member 20 is configured with at least these two apertures. After one or more support members 20 are so affixed to the vertically disposed upstanding walls, the sub-top 32 may be laid into the open space of the counter 30 and onto the support members 20. With support members having at least aperture 28' or 28" or both, the sub-top 32 also may be affixed to the support member 20 by use of a suitable fastener 38 through such apertures 28' or 28" or both and into the sub-top 32. If the support member 20 is affixed to the sub-top 32 in either or both manners, the support member 20 then should ordinarily not be affixed to the vertical upstanding wall also as, more likely than not, this will diminish the floating feature of the sub-top as created and configured.

To maintain a relatively level horizontal plane for the sub-top 32 in relation to the ends of the vertically disposed upstanding walls, the length of the vertical ledge 24 should be approximately equal to or greater the distance of the thickness of the sub-top 32; i.e., approximately X'-Y'. FIG. 4 illustrates the thickness of the sub-top 32 as being X'-Y'. The distance from the upper surface of the support ledge 26 to the bottom surface of the top ledged is represented by X-Y. Reference character 't' represents the thickness of the top ledge 22. It is best that X-Y be approximately equal to X'-Y', though X-Y may also be approximately equal to (X'-Y')+'t']. Application of cement over the entire top surface area will cover and even-out any dimension irregularities which may be caused by the addition of the top ledge 22 and thickness 't' to the upper ends of the vertically disposed upstanding walls.

As described above, application of the sub-top 32 may also be executed by first affixing the support member 20 to the bottom surface of the sub-top 32 by use of a suitable fastener 38 through aperture 28' and into the sub-top 32. After a suitable number of support members 20 are so affixed, the sub-top 32 may be inserted into the open space with the top ledges 22 placed to rest on the upper ends of the vertically disposed upstanding walls. The top ledges 22 may be, but need not be, fastened to the upper ends of the vertically disposed upstanding walls by placing a suitable fastener 38 through aperture 28 and into the upper end of the vertically disposed upstanding walls.

Best use of this support member 20 is to affix the support member 20 to the vertically disposed upstanding walls by use of a suitable faster either through aperture 28 or 28" or through both but not through aperture 28'. This process will enhance the floating concept of the present invention.

Figure 5:
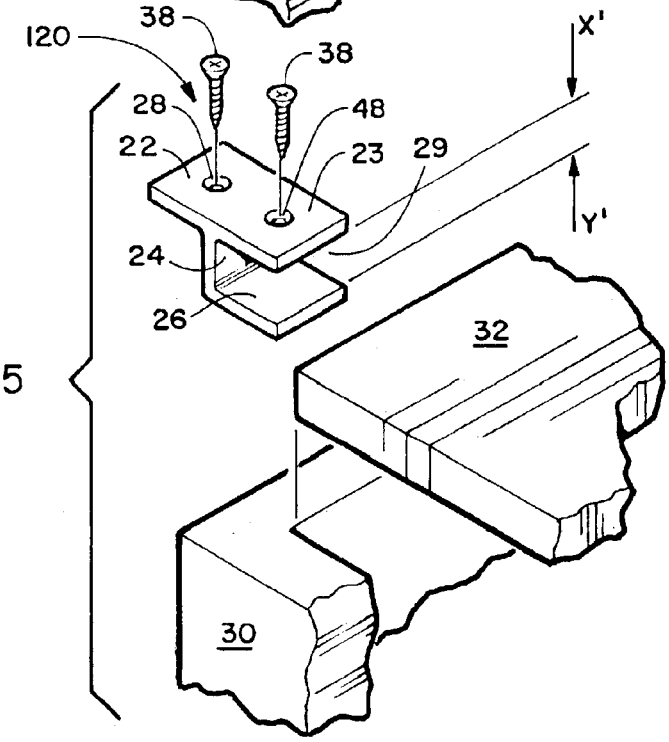
FIG. 5 is a detailed view of another embodiment of a support member for the sub-top.
Figure 6:
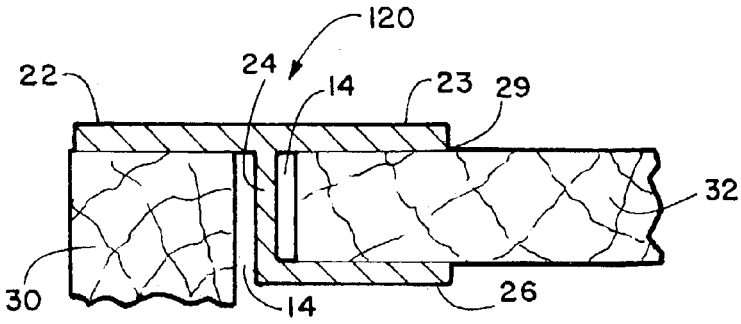
FIG. 6 is a cross-section detailed view of a support member engaging the sub-top.

Still another embodiment of a support member is illustrated in FIGS. 5 and 6. This support member 120 is similar to the previously described support member 20 in all respects except that it has a retaining ledge 23 extending outward from the top ledge 22 and inward into the open space. The retaining ledge 23 is approximately parallel to the support ledge 26 and parallel to and approximately on the same horizontal plane as the top ledge 22 thereby defining a mouth or opening 29 between the retaining ledge 23 and the support ledge 26. The width of the mouth is equal to or slightly less than X'-Y' and thereby, is adapted to receive and securely hold onto the sub-top 32 without the need of any external fastener 38.

This support member 120 may have the same apertures in the same configurations as support member 20; i.e., aperture 28 in the top ledge 22, aperture 28' in the support ledge 26, and aperture 28" in the vertical ledge 24. It also may have aperture 48 on the retaining ledge 23. The primary, though not exclusive, purposes of apertures 28', 28", and 48 would be to affix the support member 120 to the sub-top 32. As described above, if the support member 120 is affixed to the sub-top 32 it is best not to also affix this support member 120 to the vertical upstanding wall as such may diminish the functionality of the float. The better process is to slip this support member 120, by way of its mouth 29, onto the edges of the sub-top 32. Given the respective thickness of the sub-top 32 and length of the mouth 29 being approximately the same, the support member 120 will grasp onto and hold onto the sub-top. A suitable removable fastener may be inserted through aperture 48 before the sub-top 32 is placed into the open space to ensure the hold of the support member 120 on the sub-top. If this is done, it is best thereafter to remove the fastener from aperture 48 after the sub-top 32 has been placed into the open space of the counter 30. Once so placed into the open space of the counter 30, a suitable fastener 38 may be, but need not be, placed through aperture 28 of the top ledge 22 such that the sub-top 32 and support member 120 are more securely affixed to the counter 30. The configuration of this support member 120, however, does not necessitate this procedure.

After the support member 120 and sub-top 32 are inserted into the open space of the counter 30, a gap 14 remains between the vertical ledge 24 and the adjacent edge of the sub-top 32 [FIG. 6 refers]. In instances where the support member 120 was not fastened to the sub-top 32, this gap 14 permits the sub-top 32 to float within the open space of the counter 30. In instances where the support member 120 was fastened to the sub-top 32, the gap 14 will be in the space between the vertical ledge 24 and the vertically disposed upstanding wall of the counter 30. The functionality of the gaps 14 created, wherever created, is to facilitate and permit a float for the sub-top 32.

The present disclosure includes that contained in the present claims as well as that of the foregoing description. Although this invention has been described in its preferred forms with a certain degree of particularity, it is understood that the present disclosure of the preferred forms has been made only by way of example and numerous changes in the details of construction and combination and arrangement of parts and method steps may be resorted to without departing from the spirit and scope of the invention. Accordingly, the scope of the invention should be determined not by the embodiment[s] illustrated, but by the appended claims and their legal equivalents.

The invention claimed is:

1. A support member for use with a system for creating a floating sub-top to which tiles may be applied, said support member comprising:

(a) a top ledge;

(b) a vertical ledge attached to one end of said top ledge and extending down from said top ledge;

(c) a support ledge extending away from said vertical ledge in a direction opposite of said top ledge; and (d) a retaining ledge having an aperture therethrough, said retaining ledge extending from said top ledge, said retaining ledge approximately parallel to and above said support ledge defining a mouth therein.

2. The support member as claimed in claim 1 further comprising at least one aperture through said top ledge.

3. The support member as claimed in claim 1 further comprising at least one aperture through said vertical ledge.

4. The support member as claimed in claim 1 further comprising at least one aperture through said support ledge.

5. A support member for use with a system for creating a floating sub-top to which tiles may be applied, said support member comprising:

(a) a top ledge;

(b) a vertical ledge having at least one aperture therethrough, said vertical ledge attached to one end of said top ledge and extending down from said top ledge;

(c) a support ledge extending away from said vertical ledge in a direction opposite of said top ledge; and (d) a retaining ledge extending from said top ledge, said retaining ledge approximately parallel to and above said support ledge defining a mouth therein.

6. The support member as claimed in claim 5 further comprising at least one aperture through said top ledge.

7. The support member as claimed in claim 5 further comprising at least one aperture through said support ledge.

8. The support member as claimed in claim 5 further comprising an aperture through said retaining ledge.

9. A support member for use with a system for creating a floating sub-top to which tiles may be applied, said support member comprising:

(a) a top ledge;

(b) a vertical ledge attached to one end of said top ledge and extending down from said top ledge;

(c) a support ledge having at least one aperture therethrough, said support ledge extending away from said vertical ledge in a direction opposite of said top ledge; and (d) a retaining ledge extending from said top ledge, said retaining ledge approximately parallel to and above said support ledge defining a mouth therein.

10. The support member as claimed in claim 9 further comprising at least one aperture through said top ledge.

11. The support member as claimed in claim 9 further comprising at least one aperture through said vertical ledge.

12. The support member as claimed in claim 9 further comprising an aperture through said retaining ledge.

* * * * *